United States Patent [19]

Matsumoto et al.

[11] Patent Number: 4,502,776

[45] Date of Patent: Mar. 5, 1985

[54] SORTING DEVICE FOR USE WITH A DOCUMENT REPRODUCTION MACHINE

[75] Inventors: Hiroshi Matsumoto; Yoshiaki Nawata, both of Yokohama; Tsuneo Toda, Urawa, all of Japan

[73] Assignee: Tokyo Shibaura Denki Kabushiki Kaisha, Kawasaki, Japan

[21] Appl. No.: 353,932

[22] Filed: Mar. 2, 1982

[30] Foreign Application Priority Data

Mar. 31, 1981 [JP] Japan ..... 56-46163

[51] Int. Cl.[3] ..... G03G 15/00

[52] U.S. Cl. ..... 355/14 SH; 355/14 R

[58] Field of Search ..... 355/3 SH, 14 R, 14 SH

[56] References Cited

U.S. PATENT DOCUMENTS 4,090,787 5/1978 Hubbard et al. ..... 355/14 R 4,099,860 7/1978 Connin ..... 355/14

4,218,129 8/1980 Ishimoto et al. ..... 355/3 SH

*Primary Examiner*—Fred L. Braun

*Assistant Examiner*—David S. Warren

*Attorney, Agent, or Firm*—Banner, Birch, McKie & Beckett

[57] ABSTRACT

A sorting device for use with the document reproduction machine according to the present invention is constructed so that each of the sorting bins for stacking sorted copies is successively moved upward or downward with respect to the discharge port of the machine to directly receive each copy when several copies made from the same original are discharged successively from the discharge port. In a nonsort-mode, only a specified sorting bin is positioned facing the discharge port of the machine. In the sort-mode, if the document reproduction machine is not operated for a predetermined time after copying has been completed, the machine is returned to the nonsort-mode.

3 Claims, 11 Drawing Figures

SORTING DEVICE FOR USE WITH A DOCUMENT REPRODUCTION MACHINE

BACKGROUND OF THE INVENTION

This invention relates to a document reproduction machine enabling separate storage of copies.

An image forming device such as a copying machine forms a copy (an image of an original) on a sheet of copying paper. The copying paper is discharged as a copy; and multiple copies (on which the same image is formed) can be produced for one original, as well as single copies. In such a copying machine capable of producing multiple copies, sometimes separate storage of the copies is desired. It is especially important to collate the copies when a number of copies are required for several different originals.

A conventionally-used sorting device, for example, "Xerox 7000", is constructed with a plurality of stationary sorting bins for storing copies which, when discharged from the copying machine, are transported toward the sorting bins by a transport mechanism. When each copy reaches an appropriate sorting bin, the corresponding gate to the sorting bin rotates to guide the paper into the sorting bin. However, in such a sorting device, the transport mechanism connecting the copying machine with the sorting bins is relatively large, and many gates are necessary to sort the copies into each sorting bin. This results in a large apparatus inconvenient for use in an office.

To obviate these defects in conventionally-used sorting devices, a copying machine with an improved sorting device has recently been developed wherein the sorting bins themselves can be moved upward or downward to directly receive copies discharged from the copying machine. A plurality of sorting bins are successively moved toward the discharge unit of the copying machine.

In the above sorting device, if a copy of a second original is produced in the copying machine while the copies of the first original are being collated in the sorting device, the sorting bins will be out of the proper order to receive the copies of the second original. Therefore, an operator must select the sorting condition, that is, whether or not copies are to be collated. Generally, the sorting condition is called sort-mode or nonsort-mode depending upon the function. In other words, the operator must select either the sort-mode or the nonsort-mode.

A problem will result, however, if an operator leaves the copying machine when he has completed a job in the sort-mode. For instance, assume that the total number of sorting bins is 10, and after an operator makes 8 copies of an original in the sort-mode, the next operator also wants to use the copying machine in the sort-mode. In this case, the 8th sorting bin is facing the discharge unit of the copying machine. Consequently, copies made by the next operator will start to be sorted from the 9th sorting bin, resulting in confusion. If the next operator instead selects the nonsort-mode, the sorting device will be reset to store copies in the first sorting bin. However, if the next operator does not change to the nonsort-mode, and carelessly depresses the copy button, the copies will be stored beginning at the sorting bin next in succession to that used by the previous operator.

The above mentioned copying machine also has an interrupt-mode which allows an operator to copy a second original by interrupting the copying of the first.

If the interrupt-mode is designated while in the sort-mode, the sorting bins will be out of the proper order to receive copies when copying of the first original is resumed.

SUMMARY OF THE INVENTION

This invention relates to a document reproduction machine which has a sorter in which bins are moved relative to a discharge port. One object of the invention is to overcome the prior art disadvantages of such a machine, enabling it to store copies in an orderly manner.

Another object of the present invention is to accomplish the foregoing object in a manner which will keep the machine simple in construction, high in reliability, and low in cost.

In the document reproduction machine having a sorting device incorporating the present invention, the sorting bins for stacking copies are moved upward or downward toward the discharge unit of the machine to directly receive each paper when a number of copies are to be made from the same original. In the nonsort-mode, only a specified sorting bin is positioned facing the discharge port of the machine. In the sort-mode, if the machine is not operated for a predetermined time after the copying has been completed, the sorting condition is changed to the nonsort-mode.

While the document reproduction machine is operated in the multicopy-mode, producing several copies from the same original, if an operator selects the interrupt-mode to copy a second original, copying of the first original will only be interrupted if the machine is in the nonsort-mode. The size of the document reproduction machine of the present invention can be minimized, because the sorting bins receiving copies are moved upward or downward toward the machine's discharge port. Selection by the operator of the sort-mode or the nonsort-mode is possible, and the sort-mode is automatically reset to the nonsort-mode if the machine is not operated for a predetermined time after the completion of copying. In the nonsort-mode, there will be no confusion of the sorting order because only the specified sorting bin faces the discharge port of the machine. Also, since the simultaneous use of interrupt-mode and sort-mode is prohibited, no sorting order confusion will result.

DETAILED DESCRIPTION OF THE PREFERRED EMBODIMENT

While reference is made in the following description to a copying machine, it should be clear that the present invention can be employed with any document reproduction machine (e.g., facsimile machines).

Figure 1:
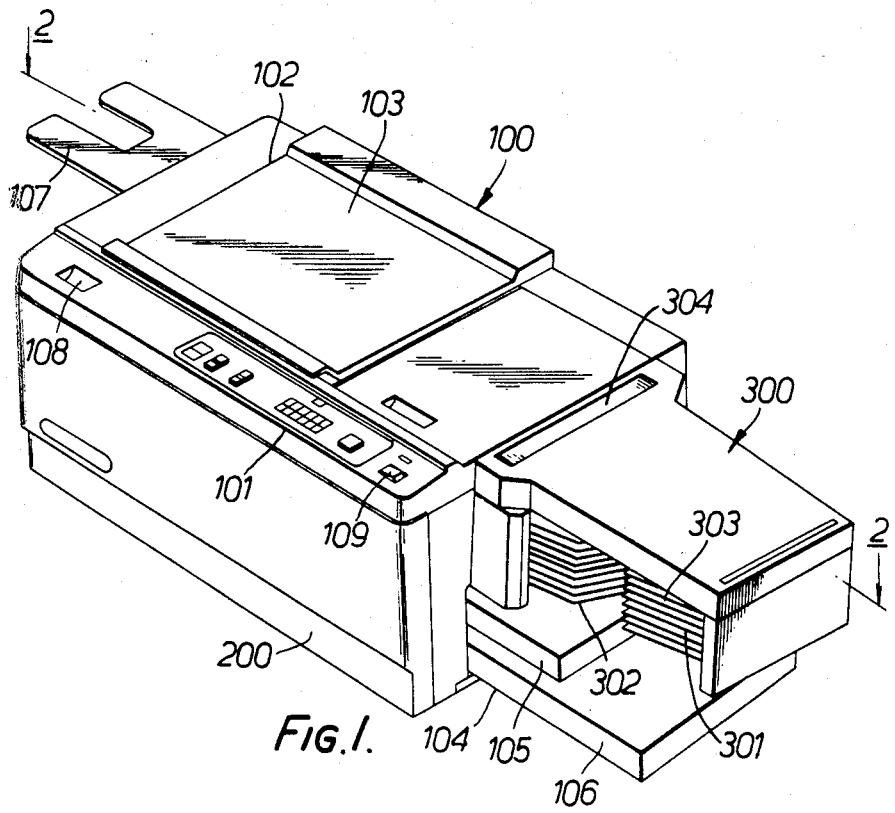
FIG. 1 is a perspective view of a copying machine with a sorting device incorporating the present invention.
Figure 2:
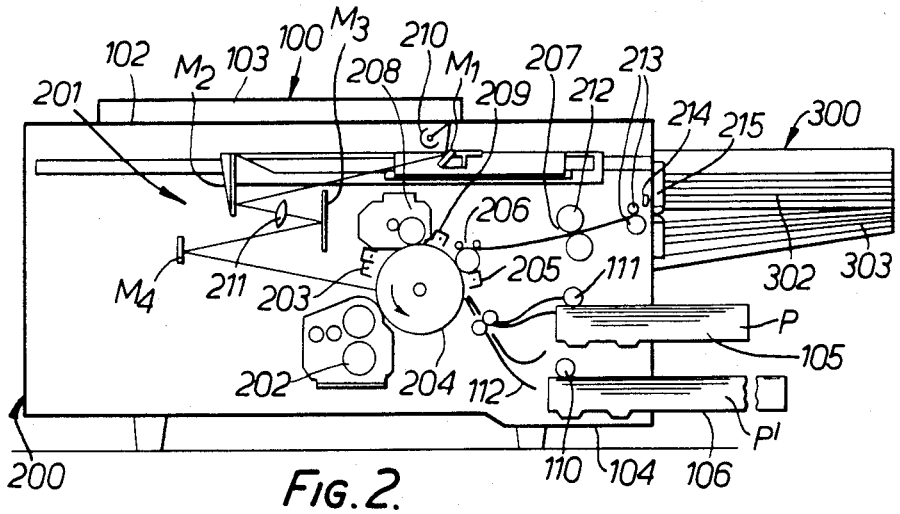
FIG. 2 is a sectional view of the copying machine with the sorting device shown in FIG. 1 taken along line 2—2 of FIG. 1.

In FIGS. 1 and 2, a copying machine consists of a main body 200, for making copies of an original, and a sorting device 300, for sorting and storing the copied papers. The main body 200 is composed of a control panel or input unit 101 through which instructions are received from the operator, an original-holder 102 which carries the original of the document to be copied, an original retaining cover 103 for holding the original flat, and paper cassettes 105 and 106 for supplying sheets of paper, one at a time, to the copying mechanism. The sorting device 300 is connected with the discharge unit of the main body 200. In this sorting device, a plurality of bins 301 and 302 are positioned in parallel to store the copies discharged from main body 200. These bins include a nonsort or storage bin 302 for storing all copies produced when the nonsort-mode is activated and separated sorting bins 301, above nonsort bin 302, for storing copies produced when the sort-mode is activated. Nonsort-bin 302 is a fixed bin while sort-bins 301 are upwardly or downwardly movable bins, of which there are ten in this embodiment (301A through 301J). The capacity of nonsort-bin 302 is greater than that of each sort-bin 301.

Near the center of copying machine 100, referring now to FIG. 2, a photosensitive drum 204 is rotatably mounted. Spaced around photosensitive drum 204 are the following units: a developer 202 for storing toner; an illuminating system 210 for illuminating the original document on original holder 102; a lens system 211 for transmitting illumination reflected from the original to photosensitive drum 204; and a charger 203 for creating a uniform electrostatic charge on the photosensitive drum 204. On one side of copying machine 100 (the right side in the figure), paper feed cassettes 105 and 106 are removably mounted. The copying paper P', fed out from lower paper feed cassette 106 by a paper feed roller 110, is led by guide plate 112 to contact the surface of photosensitive drum 204. Here, the developed image on the surface of photosensitive drum 204 is transferred to the paper by a transfer device 206. The sheet of paper P, now a copy of the original document, is transported between fusing rollers 212 which fuse the transferred toner to the paper. The copy will be stored, after being classified, in sorting device 300 which is provided outside of copying machine 100. Paper feed cassette 105, holding copying paper P of a different size than copying paper P' in cassette 106, has a feed roller 111 for feeding paper.

Further, several additional elements are spaced around photosensitive drum 204: a paper separator 205 which performs corona discharge to separate the copies from the drum, a discharger 209 for removing the charge from photosensitive drum 204, and a cleaning device 208 for cleaning the residual toner from photosensitive drum 204. In addition, there are provided transportation rollers 213 for transporting the copies to sorting device 300. Paper detector 214, at the machine's discharge unit, detects and signals the normal discharge of copies to sorting device 300 and also produces an error signal when copies are not discharged at the proper time.

Figure 3:
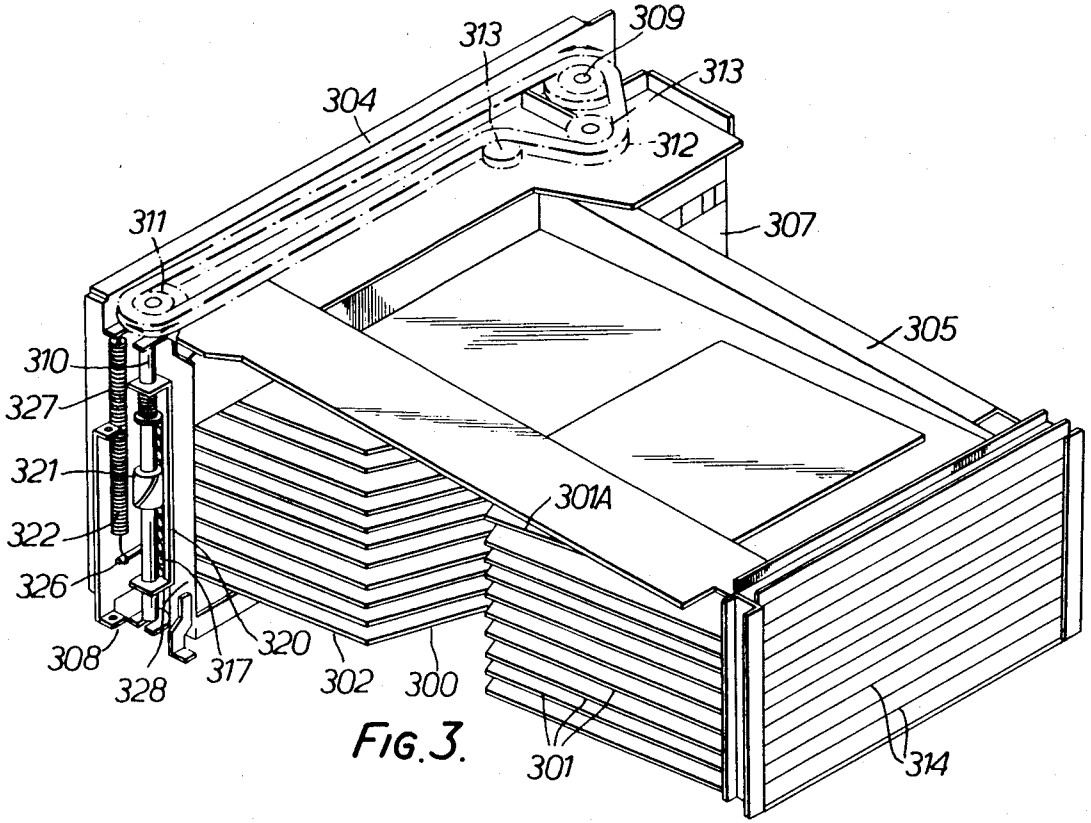
FIG. 3 is a perspective view of the sorting device shown in FIG. 1, with covers removed to show details.

As shown in FIG. 3, the sorting device 300 includes a mounting platform 304 for supporting sorting device 300 on main body 200 at the discharge unit 215, a frame 305 for supporting all sorting members on mounting platform 304, a reversible motor 307, a moving mechanism 308, and the aforementioned separated sorting bins 301. The output shaft of reversible motor 307 has a sprocket 309 while rotating shaft 310 of moving mechanism 308 also has a sprocket 311. The interconnection between sprockets 309 and 311 is accomplished by a chain 312. Further, gears 313 are idler gears for stretching chain 312.

Figure 4:
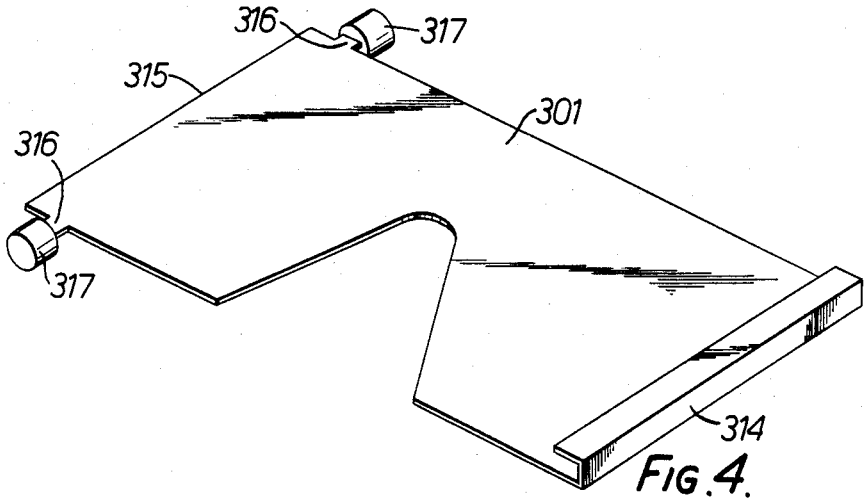
FIG. 4 is a perspective view of one of the movable separated sorting bins in the sorting device shown in FIG. 3.

As shown in FIG. 4, each sorting bin 301 is a plate made of sheet spring steel or Fiber Reinforced Plastic. The back ends 314 are bent to form a U-shape to maintain the interval between adjacent bins. (The back ends 314 of receiving bins 301 are only piled up; their movement is limited by frame 305. The center part of each bin 301 is cut away for easy removal of copies stacked on bin 301. At both ends 316 of the front 315 of each bin 301, are plastic guiding pins 317.

Figure 5:
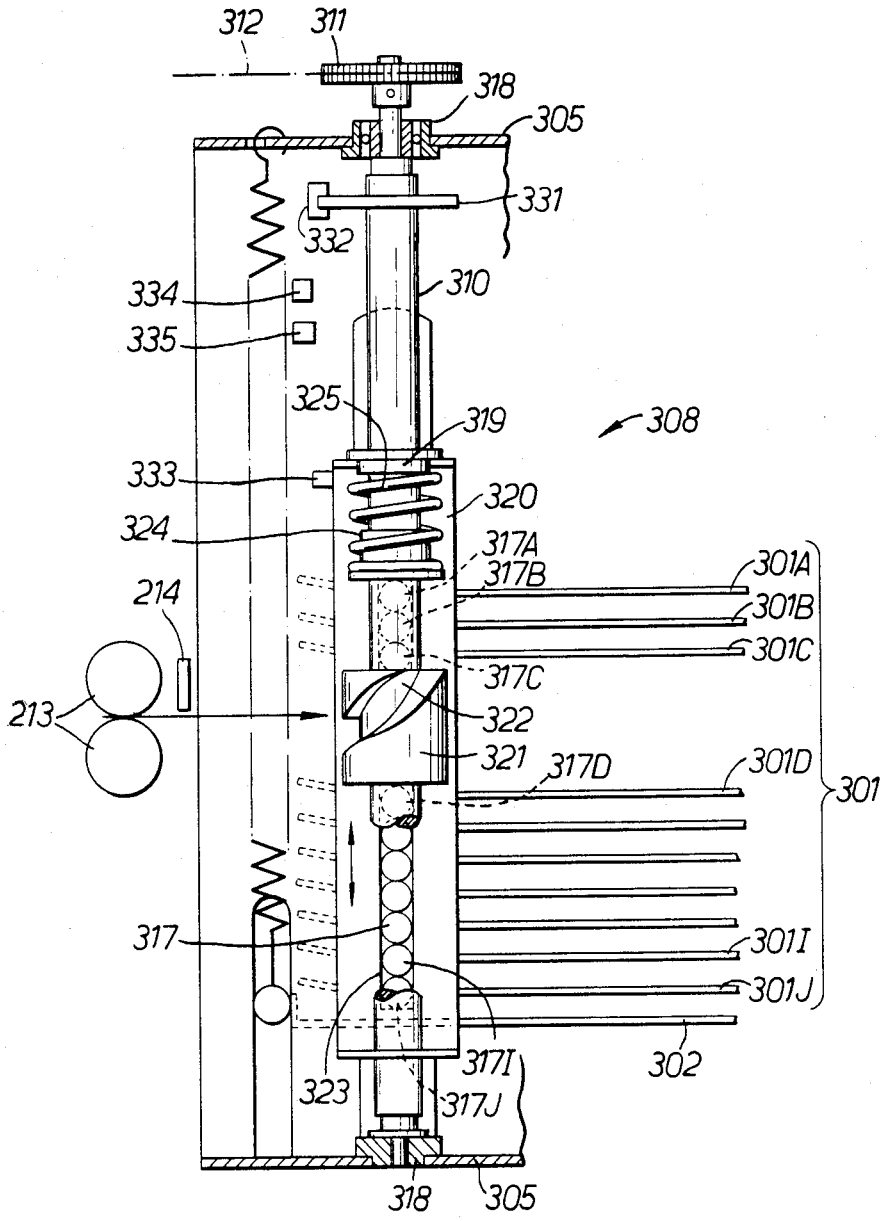
FIG. 5 is a front view of the moving mechanism which moves the movable stacking bins in the sorting device shown in FIG. 3.

Referring to FIG. 5, moving mechanism 308 is explained. In frame 305 are mounted bearings 318 for supporting opposite ends of cam shaft 310. The rotating cam shaft is provided with a movable ring 319 which is moved up and down with the rotation of cam shaft 310. The movable ring 319 is affixed to an end of a sleeve 320 which is moved up and down with the movement of ring 319. The other end of sleeve 320 is engaged with the lower portion of cam shaft 310. At about the center of cam shaft 310 is attached a cam 321 in which a helical groove 322 is formed to enable it to couple with guiding pins 317 of bins 301. Further, the guiding pins 317 all engage a longitudinal slot 323, in sleeve 320, within which the pins move upward and downward. Between cam 321 and movable ring 319, a depressing ring 324 is slidably mounted on cam shaft 310 for pressing downward on the top guiding pin, the downward force being provided by a compression spring 325. The other end of spring 325 presses against ring 319 and therefore sleeve 320. The force of spring 325 therefore presses all guiding pins 317 toward cam 321, ensuring that, if the cam rotates to a position from which a pin 317 can enter groove 322, the pin will do so. This will happen whether the pin is above or below cam 321. At the upper portion of cam shaft 310 is mounted a timing disk 331 which has a notch (not shown). Timing detector 332 on frame 305 detects each rotation of disk 331 by noting the passage of this notch.

A lever 333 is attached to sleeve 320; the lever's upward and downward movement is detected by nonsort-home detector 334 and sort-home detector 335, both of which are mounted on frame 305. Nonsort-home detector 334 is used for detecting (in conjunction with lever 333) that the lowest one of the guiding pins 317, corresponding to the lowest separated sorting bin 301J, is positioned on the upper surface of cam 321. At that time, all separated sorting bins 301A through 301J are positioned above the upper surface of cam 321. Sort-home detector 335 is used for detecting (in conjunction with lever 333) that the lowest one of the guiding pins 317, corresponding to the lowest separated sorting bin 301J, is positioned below cam 321 while the other guding pins 317, corresponding to the other separated sorting bins 301A through 301J, are positioned above cam 321. In that case, the first copy discharged from main body 200 is stacked on the first sorting bin 301J.

When motor 307 rotates in the forward direction, the rotation is transmitted to sprocket 311 to rotate cam shaft 310. With the rotation of cam shaft 310, cam 321 is rotated in the same direction so that one guiding pin 317 of bin 301 is coupled with helical groove 322 and expelled downward. When cam 321 is rotated one revolution (this is detected by timing detector 332), the guiding pin 317 of bin 301 is positioned beneath the lower surface of cam 321. One bin (e.g., 301C in FIG. 5), and its corresponding guiding pin (e.g., 317C in FIG. 5) in contact with the upper surface of cam 321, is separated by cam 321 from another bin (e.g., 301D in FIG. 5), and its corresponding guiding pin (e.g., 317D in FIG. 5) in contact with the lower surface of cam 321. A large space (of the height of cam 321) is formed to receive the next copy discharged by transportation roller 213. The discharged copy is stored in the bin (e.g., 301D in FIG. 5) which corresponds to the guiding pin in contact with the lower surface of cam 321. Each bin 301 is forced upwardly or downwardly by compression spring 325. Therefore, when helical groove 322 is rotated to a position where it can receive one guiding pin 317, the guiding pin 317 is coupled with the groove 322 and, upon further rotation of cam 321, expelled downwardly or upwardly. A moving mechanism 308, as shown in FIG. 3, may be positioned on one or both sides of mounting platform 304 to hold guiding pins 317 provided on either or both ends of pin 301 to move each bin 301 vertically.

Figure 6:
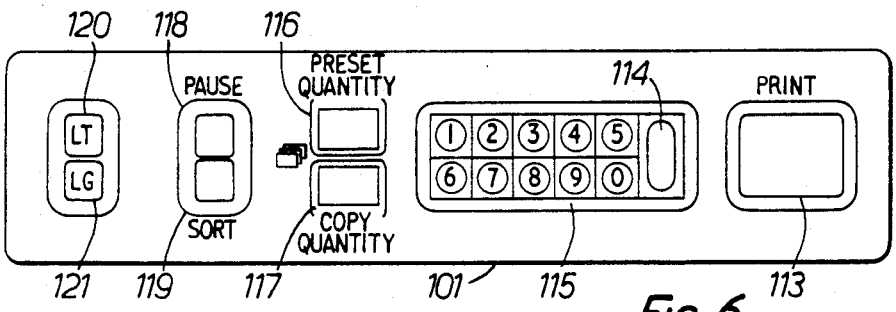
FIG. 6 depicts the control panel of the copying machine shown in FIG. 1.

The control panel 101 of copying machine 100 is shown in detail in FIG. 6. A copy key 113 is used for inputting an instruction to start producing a selected number of copies. Key pad 115 is used by the operator to indicate how many copies of each original document are desired. If a number greater than 1 is selected, main body 200 operates in the multicopy-mode. A clear key 114 is used for clearing the number selected on key pad 115. A preset quantity indicator 116 indicates the selected number of copies selected on key pad 115; a copy quantity indicator 117 indicates the number of copies which have been produced by copying mechanism 209 in response to the operator's instructions. Therefore, the contents of preset quantity indicator 116 are not changed until an entire copying operation of one original is completed, while the contents of copy quantity indicator 117 are incremented by one each time another copy is produced. An interrupt key 118 is used for activating the interrupt mode while the machine is in the multicopy-mode. A sort key 119 is used for activating the sort-mode and deactivating the nonsort-mode. These keys 118 and 119 are self-illuminating button switches; by depressing once, the interrupt mode or the sort-mode is activated, and the switch is illuminated; by depressing the key again, the modes are deactivated. Self-illuminating cassette keys 120 and 121 are used for specifying from which cassette (105 or 106) a sheet of paper is to be fed. When key 120 is depressed, cassette 105 is selected in which letter size papers are stored. When key 121 is depressed, cassette 106 is selected in which legal size papers are stored.

Figure 7:
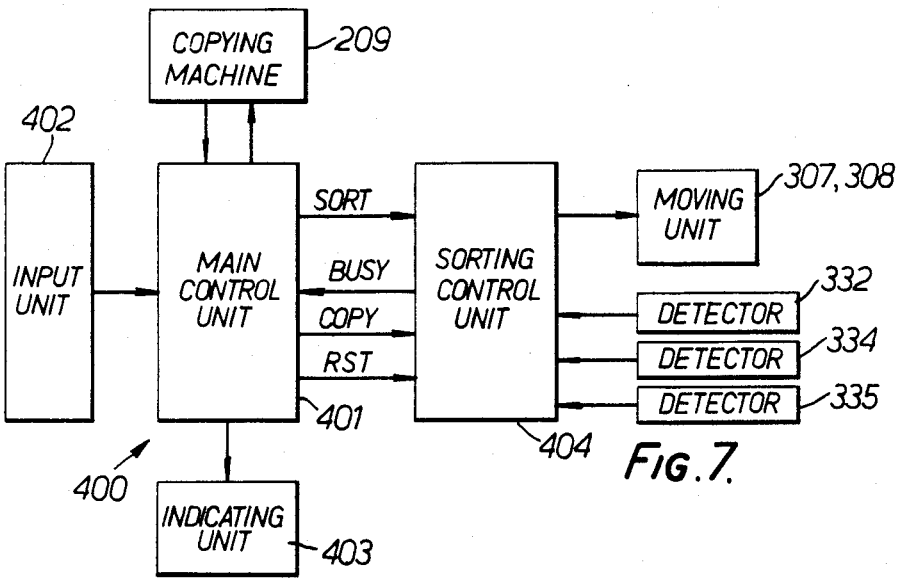
FIG. 7 is a schematic block diagram of the control media of the copying machine shown in FIG. 1.

As shown in FIG. 7, the machine's control 400 is provided by a main control unit 401, controlling the main body 200 and sorting device 300, and a storing control unit 404 for controlling the operation of sorting device. The main control unit 401 is connected to an input unit 402 having a plurality of registers to store each instruction input by operating each key (113, 114, 115, 117, 118, 120 or 121). An indicating unit 403 is connected to main control unit 401 to display the necessary information to an operator by various indications. Besides indicators 116 and 117, indicating unit 403 has a display (not shown) for indicating each abnormality (jam in copying mechanism 209, toner shortage, paper shortage in cassettes 105 and 106, etc.). Indicating unit 403 includes a device for illuminating keys 118 to 121. That is, when the interrupt-mode is activated, the lamp in key 118 is lighted, and when key 118 is reset, the lamp is extinguished.

Figure 8:
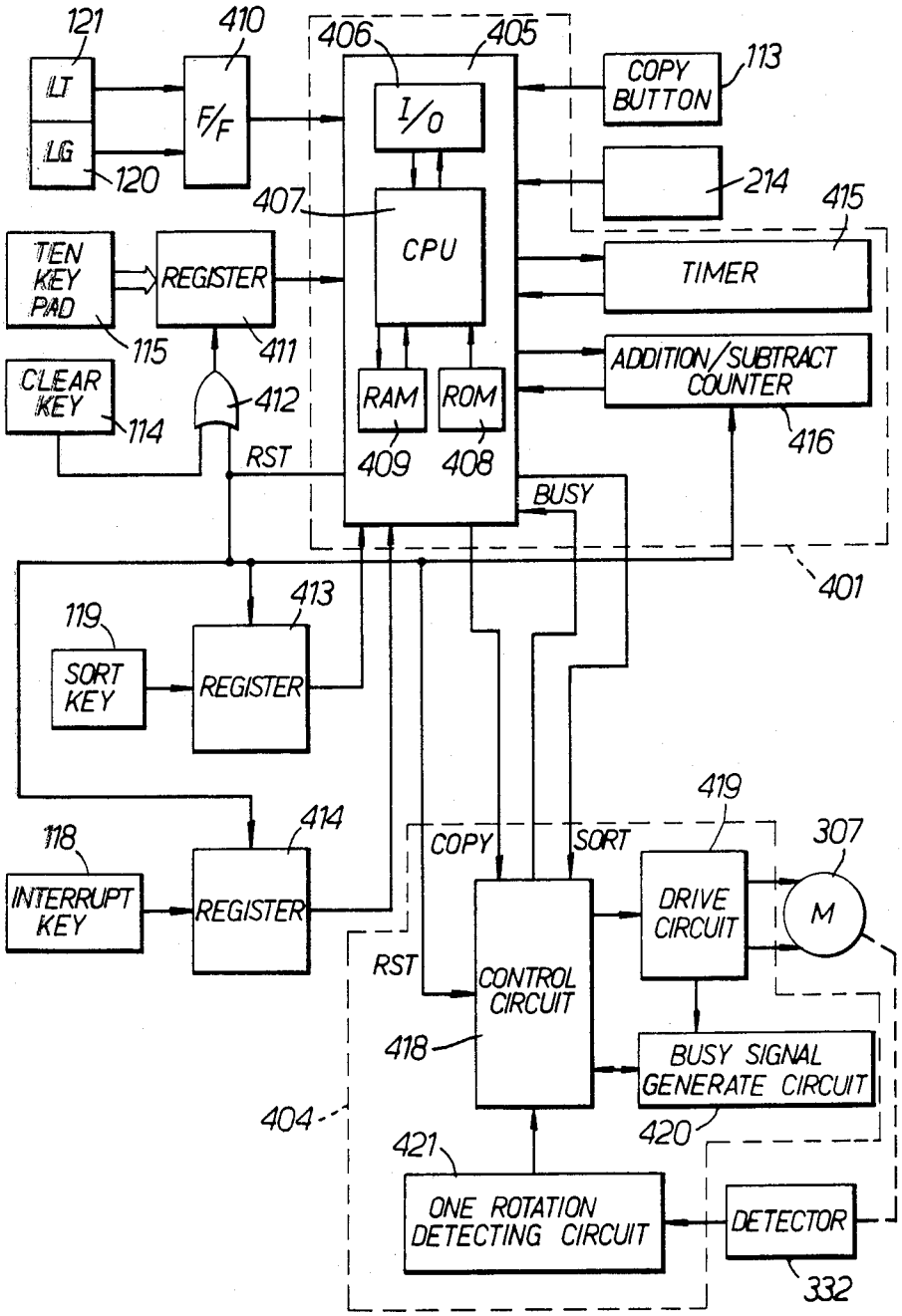
FIG. 8 is a more detailed schematic block diagram combining portions of FIGS. 6 and 7.

From main control unit 401, three types of signals, SORT, COPY and RST, are transmitted to sorting control unit 404. The SORT signal is set when the sort mode is activated by key 119, and reset when key 119 is released and the nonsort-mode is activated. The COPY signal includes two types of signals. The first COPY signal (COPY 1) is output when a copy from discharge unit 215 is detected by paper detector 214; the second copy signal (COPY 2) is output when the final one of the selected number of copies has been produced. RST signal is output while copying machine 100 is being reset and initialized. The moving unit, composed of reversible motor 307 and moving mechanism 308, is connected to sorting control unit 404 which controls of the function of the moving unit. Detectors 332, 334 and 335 are connected to sorting control unit 404 which receives the signals from each. From sorting control unit 404, one signal (BUSY) is output to main control unit 401. The BUSY signal is set when the moving unit is operating and copies cannot be received. Conversely, when copies can be received in the sorting device 300, the BUSY signal is reset. FIG. 8 shows in greater detail the main parts of control unit 400 shown in FIG. 7. Control circuit 405 is a microcomputer, and includes an I/O controller 406 for controlling the sending and receiving of information between control circuit 405 and each other circuit connected to it. CPU 407 performs arithmetic and logic functions, RAM 409 is a read-write memory, and ROM 408 is a read-only memory. In ROM 408 is stored the control program described later; the control by CPU 407 is performed according to the program stored in ROM 408. RAM 409 temporarily stores necessary data when CPU 407 is performing control functions. A timer 415 and an addition/subtraction counter 416 are connected to control circuit 405. Timer 415 is a retrigger-possible timer which starts the timer operation by responding to the start instruction from control circuit 405, and outputs a timeout signal after a specified time has passed. Addition/subtraction counter 416 stores the number of copies selected by the operator on key pad 115 and subtracts one in response to each signal from paper detector 214. Main control unit 401 is composed of control circuit 405, timer 415, and addition/subtraction counter 416.

A flip-flop 410 and three registers 411, 413, and 414 (which store instructions input at keys 114, 115, 118, 119, and 121) are connected to control circuit 405. The data input from key pad 115 is temporarily stored in register 411 and is cleared by inputting the clear signal from clear key 114 through OR gate 412. Copy button 113 is directly connected to control circuit 405. Each register 411, 413 and 414, and counter 416, are reset and initialized by reset signal RST output from control circuit 405. Sorting control circuit 418 is used to control the drive of the moving unit. A drive circuit 419 for driving motor 307, BUSY signal generating circuit 420, and a one-rotation detecting circuit 421 are connected to control circuit 418. Drive circuit 419 drives motor 307 forward or backward, or stops, in response to instructions from control circuit 418 (the rotating state of motor 307 is expressed as motor ON, the stopped state as motor OFF). A BUSY signal generating circuit 420 sets the BUSY signal when motor 307 is rotating (in either direction), and resets the BUSY signal when the motor is stopped. One-rotation detecting circuit 421 outputs a signal which shows that cam 321 has performed one complete rotation when detector 332 detects the notch of disk 331. This is also an indication that a sorting bin 301 has moved up or down. Sorting control unit 404 is composed of sorting control circuit 418, drive circuit 419, BUSY signal generating circuit 420, and one-rotation detecting circuit 421.

The operation of the copying machine will be explained referring to the flowcharts shown in FIGS. 9 and 10.

(1) When the nonsort-mode is activated and the sort-mode is deactivated.

First, an operator applies power to the copying machine by operating power switch 109 on main body 200. After setting a document to be copied on original holder 102, the operator inputs the number of copies to be produced using key pad 115. The number input is displayed on indicator 116. After pressing cassette key 120 or 121 to specify the desired size of paper, the operator depresses copy button 113. At this time, he does not depress the sort key 119 because the nonsort-mode is desired.

This starts the copying operation. The initial reset is performed by applying power. Upon receipt of power by CPU 407, RST signal is output. In the initial reset state, "1" is indicated on indicator 116, "0" is indicated on indicator 117, lamps contained in interrupt key 118 and sort key 119 are extinguished, cassette key 121 is selected, and timer 415 is reset. Further, sorting device 300 is initialized (as shown in FIG. 10). The initialization is started by the control unit 404 deciding whether or not the signal, output by nonsort-home detector 334 when it detects lever 333, is present. If so, it is considered that sorting device 300 is in the nonsort home position; if not, sorting device 300 is moved to the nonsort home position. In the nonsort home position, nonsort bin 302 is positioned under the lower surface of cam 321, guiding pin 317J of the lowest sort bin 301J touches the upper surface of cam 321, and copies discharged from main body 200 are all piled and stored on nonsort storage bin 302.

When sorter 300 is not in the nonsort home position, the signal to reset sort register 413 is output from CPU 407 and the sort mode is deactivated by the initial reset operation. Further, from BUSY signal generating circuit 420, the BUSY signal is set and output to control circuit 405 upon command of control circuit 418. The drive circuit 419 rotates motor 307 in the reverse direction by responding to instructions from sorting control circuit 418. In the sorting control circuit 418, a register (not shown) stores the rotating direction of motor 307 before the motor stops. When motor 307 rotates in the reverse direction, since cam 321 also rotates in the reverse direction, guiding pins 317 on sort bins 301 engage in sequence with groove 322 of cam 321 and move up. Thus, all the sort bins 301 are raised, and guiding pin 317J on the lowest sort bin 301J touches the upper surface of cam 321. Even if cam 321 rotates more, bins 301 will not rise any farther. At this point, since sleeve 320 rises as bins 301 rise, lever 333 is detected by nonsort-home detector 334. Thus, movement to the nonsort home position continues until the detection signal comes from nonsort detector 334. When movement to the nonsort home position is completed, sorting control circuit 418 signals drive circuit 419 to turn off motor 307, and the BUSY signal from BUSY signal generating circuit 402 is reset. Thus, sorting device 300 is initialized.

Figure 9:
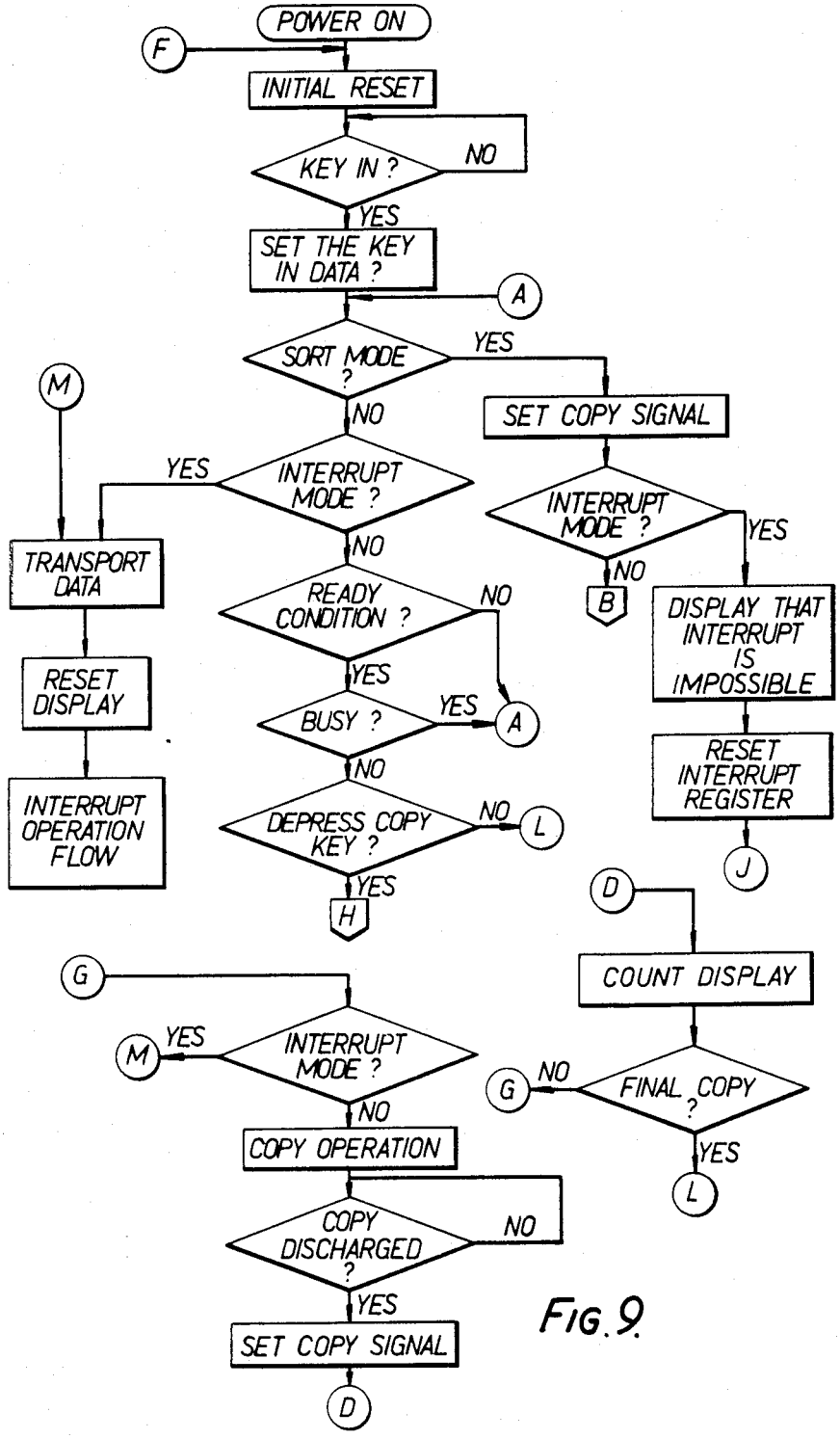
FIGS. 9, 10 and 11 are flow charts to illustrate the operation of the copying machine shown in FIG. 1.

Referring to the flowchart in FIG. 9, each instruction input by each key 115, 120 or 121 is stored in flip-flop 410 or in register 411, and in the next step, the instruction is read into main control unit 401 and stored in RAM 409 through I/O controller 406.

In the next step, in control circuit 405, whether the sort mode is activated is decided by reading the data stored in RAM 409. In this case, since the nonsort-mode is selected, the decision on the sort-mode proceeds to "NO" in the flow chart in FIG. 9.

In the next step, the decision on the interrupt-mode is performed. In this case the decision also proceeds to "NO". Next, the decision on the ready condition is performed. In this case, the ready condition is present, so the decision proceeds to "YES."

The decision as to the BUSY condition is next performed. As described previously, since the BUSY signal from sorting control circuit 418 is reset, the decision proceeds to "NO." Also, whether copy button 113 is depressed is decided, and, if it is, the decision proceeds to terminal H in FIG. 10. When the ready condition is not present, or the BUSY signal is set, the decision returns to terminal A in FIG. 9. If copy key 113 is not depressed, the decision proceeds to terminal L in FIG. 11.

Figure 10:
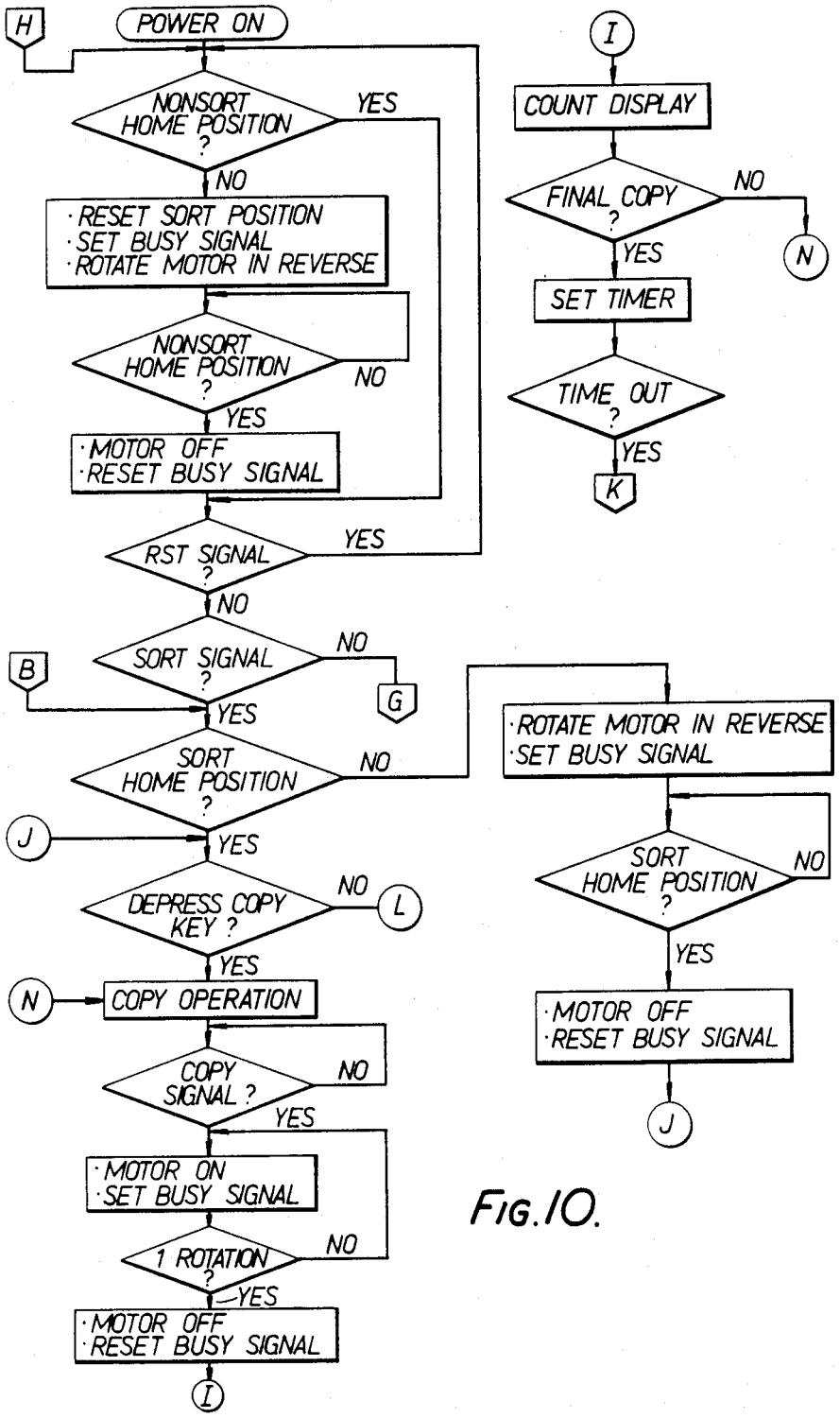

At terminal H in FIG. 10, the first decision is whether sorting device 300 is in the nonsort home position. In this case, since the initial reset has been performed, the decision proceeds to "YES," and then the presence of the RST signal is checked. Because the reset and initialization process is complete, no RST signal is present, and the decision proceeds to "NO." Next, the decision on the sort-mode is performed and, since the nonsort-mode has been activated, the decision returns to terminal G in FIG. 9. The interrupt mode is checked, and, since it has not been selected, the copying operation begins. As the copying of the document is performed, control circuit 405 enters a loop which waits for signals from paper detector 214 indicating the discharge of copies. When such a signal is output from paper detector 214, control circuit 405 outputs the COPY 1 signal to sorting control unit 404. In this case, since the nonsort-mode is activated, the sorting control unit does not respond to the COPY 1 signal. As repeated copies are produced, the COPY 1 signal is sent to counter 416 which subtracts 1, for each copy, from the total selected on key pad 115; when the total becomes "0", it is sent to control circuit 405. The contents of counter 416 are continuously indicated on indicator 117 as the number of copies produced. The copies discharged by discharge unit 215 are all stored on nonsort storage bin 302. When the final one of the selected number of copies has been produced, the decision on the final copy proceeds to "YES" and therefore to terminal L in FIG. 11. Control circuit 405 starts timer 415 by responding to the "0" signal from counter 416, and then the waiting loop is entered, waiting for timeout. When the timeout signal is output from timer 415, the loop returns to terminal K where the machine moves all bins to the nonsort-home position, then to terminal F in FIG. 9, where the initial reset is performed.

(2) When the sort-mode is activated and the nonsort-mode is deactivated.

In this case, the steps preceding the decision on the sort-mode in the flowchart in FIG. 9 are the same as in the case of (1) above. When a decision on the sort-mode is called for, the decision proceeds to "YES"; and the SORT signal is output from main control circuit 405 to sort control circuit 418. Next, the decision on the interrupt-mode is performed; in this case, the decision proceeds to "NO" and jumps to terminal B in FIG. 10. At this time, the decision whether sorting device 300 is in the sort home position is performed; the matter is judged in sorting control unit 404 by detecting the output of the signal from sort-home detector 335 which detects lever 333. If sorting device 300 is not in the sort home position, sorting control circuit 418 instructs drive circuit 419 to rotate motor 307 in reverse. At the same time, the BUSY signal is set by BUSY signal generating circuit 420 and output to main control unit 401. The decision proceeds to the loop judging the sort home position, and awaits the signal from sort-home detector 335. In the sort home position, guiding pin 317J of the lowest sorting bin 301J touches the lower surface of cam 321; and guiding pin 317I of the next to the lowest sorting bin 301I touches the upper surface of cam 321; the first copy discharged from discharge unit 215 is stored on the lowest of the separated sorting bins 301J. If the sort home position is confirmed by detector 335, control circuit 418 instructs drive circuit 419 to stop the rotation of motor 307, and the BUSY signal is reset and output to main control unit 401. When the operation is completed, the decision returns to terminal J. After the copy key is depressed, when COPY 1 signal is output from main control unit 401, control circuit 418 instructs drive circuit 419 to rotate motor 307 forward. The BUSY signal is set and output to main control unit 401.

Next, the decision enters a loop to detect whether cam 321 has rotated one full turn. When cam 321 rotates exactly one turn, the signal showing that fact is output from detector 332 to control circuit 418. Upon one complete rotation of cam 321, drive circuit 419 is instructed to stop motor 307. At the same time, the BUSY signal is reset and output to main control unit 401. In this state, guiding pin 317I of bin 301I, the second from the lowest, touches the bottom surface of cam 321, and an ample space is formed between the second (301I) and the third (301H) bins from the lowest; preparation for storing the second copy on sort bin 301I is completed. Main control unit 401 successively counts the number of copies produced. Next, the decision on the final one of the selected number of copies is performed. Since a "0" signal is output from counter 416, the COPY 2 signal is output from main control unit 401 to sorting control unit 404; by this procedure, the final copy is judged. When the COPY 2 signal is output from main control unit 401, sorting control unit 404 recognizes the completion of the arrangement of copies of the first original. If the final copy has not been produced, the decision returns to terminal N and copies continue to be stored in sorting bins 301. The sorting bins are lowered one step for each rotation (forward) of cam 321, and each copy discharged from discharge unit 215 is stored in the sorting bin 301 whose guiding pin touches the bottom of cam 321. When the final one of the selected number of copies has been produced, timer 415 is set. When the timeout signal is output from timer 415 to control circuit 405, the decision returns to terminal K in FIG. 11, then to terminal F in FIG. 9 where the aforementioned initial rest is performed. If any instruction to produce copies is input to input unit 402 before the timeout signal is output, control circuit 405 stops the operation of timer 415. When the operator sets a second original on original holder 102 and starts the copying operation, the previously-described sequence of operations is repeated. If 9 copy papers for the first original had been specified, sort bin 301B would have been positioned at the lower surface of cam 321. By rotating motor 307 in reverse, the copies of the second original are successively stored in sorting bins 301B to 301J. In this case, the contents of the register storing the direction of rotation of motor 307 are checked, and the instruction to rotate motor 307 in reverse is output from control circuit 418 to drive circuit 419.

(3) When the interrupt mode is selected while in the nonsort-mode

The interrupt mode is selected by operating interrupt key 118. Control circuit 405 immediately stores the contents of addition/subtraction counter 416 in RAM 409, and resets indicators 116 and 117 (that is, indicator 116 indicates "1" and indicator 117 indicates "0"). At this time, the lamp contained in interrupt key 118 lights. In interrupt flow, on the basis of the data input by key pad 115 together with the operation of interrupt key 118, copying done by responding to an input to key pad 115. The processing of this section is the same as that of the flow starting from terminal G in FIG. 9; and copies made in the interrupt mode are stored in nonsort storage bin 301. When the necessary number of copies has been made, control circuit 405 transfers the data in RAM 409 to counter 416, and restores indicating unit 403 to its state before the interruption; simultaneously, the start signal is given to timer 415. If the person who was operating the machine before the interruption has left, since input unit 402 is not operated before the timeout signal is output from timer 415, timer 415 is not retriggered and the initial rest is performed in response to the timeout signal. On the contrary, if an instruction is input to input unit 402 before the timeout signal occurs, the copying operation is resumed from the condition before the interruption.

(4) When the interrupt mode is selected while in the sort-mode.

Figure 11:
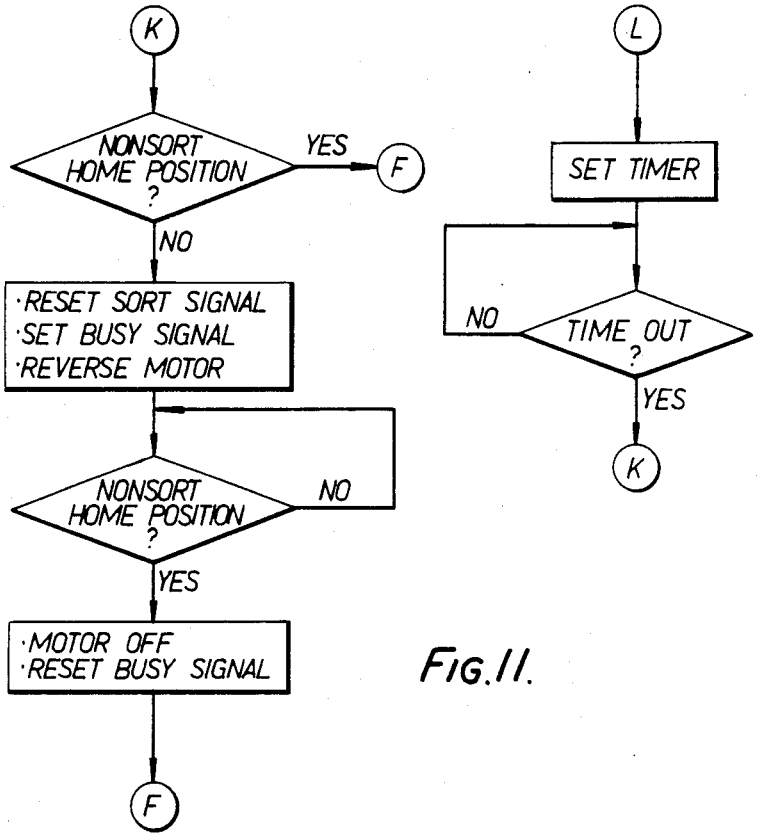

If interrupt key 118 is operated at the time of the sort-mode, the processing of the interruption proceeds as in FIG. 9. Since control circuit 405 resets register 414, the lamp contained in interrupt key 118 is extinguished. Therefore, the operator who has depressed interrupt key 118 recognizes that the copying machine cannot be in the interrupt-mode because of the sort-mode. If the operator who had been using the machine in the sort-mode depresses copy key 113, the decision-making process continues to terminal J in FIG. 10. Copying machine 100 continues copying in the sort-mode unit the copying operation is completed. For instance, if an operator operates key "8" of key pad 115 to make 8 copies, the first copy is stored in sort bin 301J and then the next sort bin lowers to store the next copy; the sorting operation is repeated for each copy. When the sixth copy is stored in the sixth sort bin 301E, if another operator who requires interruption depresses interrupt key 118, the interrupt mode is inhibited. If the operator of the sort mode (the first operator) depresses copy key 113 before the predetermined timeout time, copying machine 100 makes the 7th copy of that original and stores it in sort bin 301D. The remainder of the copying operation continues in the sort-mode. As shown in FIGS. 9 and 11, after interrupt register 414 is reset, timer 415 is set by control circuit 405. If copy key 113 is not depressed during the predetermined time set by timer 415, the decision returns to terminal K and then to terminal F, and the initial reset is performed.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A document reproduction machine comprising:

input means for receiving an instruction from an operator to produce a selected number of copies of a document;

operating means responsive to said input means for producing the copies in response to the instruction;

timing means responsive to the condition of said operating means for generating a signal when said operating means has not produced a copy for a predetermined length of time;

discharge means connected to said operating means for discharging the copies;

sort means proximate said discharge means for sorting the discharged copies when said machine is operating in a sort copying mode, said sort means including a plurality of sorting bins to store the discharged copies and moving means for moving said sorting bins relative to said discharge means;

nonsort means proximate to said discharge means for storing the discharged copies when said machine is operating in a nonsort copying mode;

control means connected to said timing means and said moving means for switching said machine from one of said copying modes to the other when said timing means generates the signal by activating said moving means; and interrupt means connected to said operating means and said input means for allowing said operating means to produce copies of a second document in response to a second instruction before the final copy of a first document is produced in response to a first instruction, said interrupt means being inoperative while said machine is in the sort copying mode.

2. A document reproduction machine as claimed in claim 1 wherein said switching means comprises means for preventing operation of said interrupt means while said machine is in the sort copying mode.

3. A document reproduction machine as claimed in claim 1 wherein said control means comprises means for switching said machine from the sort copying mode to the nonsort copying mode in response to the signal when said machine is in the sort copying mode.

* * * * *